US005224754A

United States Patent [19]

Jeanes, III

[11] Patent Number: 5,224,754

[45] Date of Patent: Jul. 6, 1993

[54] COMMODE AND SEAT ASSEMBLY

[75] Inventor: Isaac W. Jeanes, III, 119 Spruce St., Pulaski, Va. 24301

[73] Assignees: Comfy Care, Inc.; Isaac W. Jeanes, III, Pulaski, Va.

[21] Appl. No.: 626,836

[22] Filed: Dec. 12, 1990

Related U.S. Application Data

[63] Continuation-in-part of Ser. No. 131,648, Dec. 10, 1987, Pat. No. 5,110,183.

[51] Int. Cl.[5] ..... A47C 7/62

[52] U.S. Cl. ..... 297/193; 4/483; 5/604

[58] Field of Search ..... 297/193; 5/604, 605; 4/479, 480, 483

[56] References Cited

U.S. PATENT DOCUMENTS

| | | | |
|---|---|---|---|
| 10,840 | 4/1851 | VanAllen . | |
| 29,038 | 7/1860 | Keene . | |
| 557,614 | 4/1896 | Schmitt . | |
| 847,758 | 3/1907 | Frye . | |
| 861,092 | 7/1907 | Cling . | |
| 915,346 | 12/1902 | Brubaker . | |
| 1,186,059 | 6/1916 | Yarrington . | |
| 1,227,022 | 5/1917 | Thompson . | |
| 1,307,668 | 6/1919 | Henderson | 5/604 |
| 1,636,705 | 7/1927 | Prettenthaler | 5/604 |
| 1,884,577 | 10/1931 | Comper . | |
| 1,903,901 | 4/1933 | Masslow | 5/604 |
| 2,086,550 | 7/1937 | Hartig . | |
| 2,483,612 | 10/1949 | Beem . | |
| 2,656,549 | 10/1953 | Osbon . | |
| 2,676,643 | 4/1954 | Miller . | |
| 3,215,469 | 11/1965 | Wamsley . | |
| 3,943,583 | 3/1976 | Ishikawa . | |
| 4,067,409 | 1/1978 | DiMatteo . | |
| 4,244,764 | 1/1981 | Ginsburg . | |
| 4,472,848 | 9/1984 | Newman . | |
| 4, 514,867 | 5/1985 | Jensen . | |

FOREIGN PATENT DOCUMENTS

| | | | |
|---|---|---|---|
| 424468 | 1/1926 | Fed. Rep. of Germany | 5/90 |
| 341866 | 1/1931 | United Kingdom | 5/90 |

*Primary Examiner*—Peter R. Brown

[57] ABSTRACT

The infirm or disabled often face problems of great magnitude in meeting basic toilet needs. The present assembly seeks to solve problems associated with having to transfer from a chair or bed device to a separate device such as a commode chair or bathroom commode. The assembly relates to a seat insert assembly and a commode assembly that can be used within an article of furniture. The seat insert assembly rotates at two points to control the angular positioning of the seat insert so as to optimize occupant comfort and to provide a near seamless transition with the seat when in motion. The commode assembly has rotating mechanism to position a commode receptacle, to keep the commode substantially vertical during movement, and to cover the commode lid for temporary storage of waste.

14 Claims, 9 Drawing Sheets

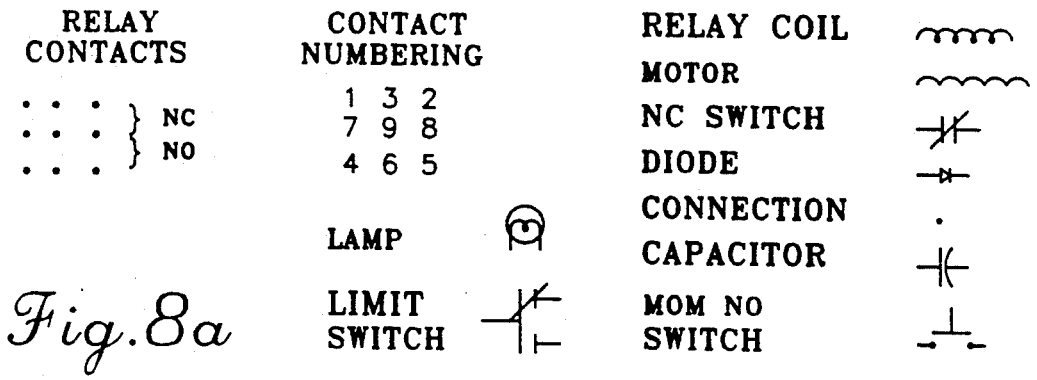
Fig. 8a
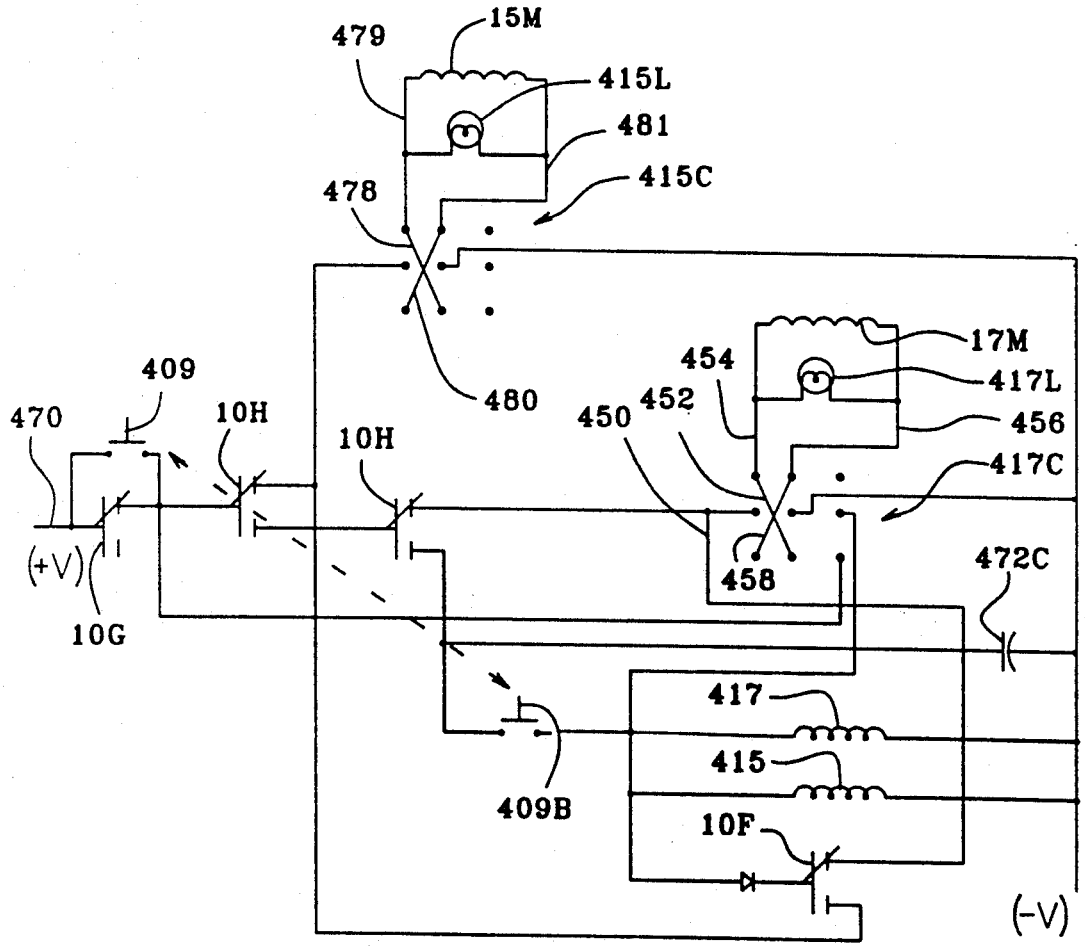

COMMODE AND SEAT ASSEMBLY

STATUS

The present application is a continuation in part of application Ser. No. 07/131,648, filing date Dec. 10, 1987, inventor Isaac W. Jeanes III, allowed Sep. 27, 1990, jointly assigned to Isaac W. Jeanes III (an individual) and Comfy Care, Inc. (a corporation), U.S. Pat. No. 5,110,183. The contents of which by reference is embodied herein.

FIELD OF INVENTION

The present invention relates to a commode mechanism with a seat insert that provides a toilet within chair and bed type devices, and within Home Chair devices of the kind in the parent application, said devices herein referred to as articles of furniture.

BACKGROUND OF THE INVENTION

Data indicates that in the early 1980's approximately 1,203,300 people used wheelchairs, 1,016,500 were bedfast, and 1,418,00 were either incontinent or required assistance using a commode. These populations appear to be doubling every nine years. Approximately 65.5% of those requiring toilet assistance are cared for at home and others are often forced into nursing homes because of inability to meet basic toilet needs. Though the wheelchair has become an international symbol of the disabled, it can be seen that toilet care may represent problems of equal magnitude.

For infirm or disabled persons, the present invention seeks to solve problems associated with having to transfer from a chair or bed device to a separate device such as a commode chair or a bathroom commode. Prior art has attempted to deal with such difficulties either by backing a wheelchair over a receptacle such as a bathroom commode or by providing devices within an article of furniture to accommodate commodes and devices to assist the occupant in either defecating or urinating. Though the history of various apparatus in the field is long, prior art has yet to attain widespread commercial success or meet the needs of the infirm, particularly those requiring home care.

Some representative U.S. Patents in the field are listed as follows: U.S. Pat. Nos. 10,840 Van Allen; 29,038 Keene; 847,758 Frye; 861,092 Cling; 915,346 Brubaker; 1,227,022 Thompson; 1,884,577 Comper; 1,186,059 Yarrington; 2,086,500 Hartig; 2,483,612 Beem; 2,656,549 Osbon; 2,676,643 Miller et al.; 3,215,419 Wamsley; 3,943,583 Ishikawa; 4,067,409 DiMatteo et al; 4,244,764 Ginsburg; 4,472,848 Newman; and 4,514,867 Jensen.

U.S. Pat. No. 557,614 Schmitt discloses a commode and seat insert rotatable about a single axis in which vertical positioning of the bed pan (o) is determined by gravity and in which seat insert (c) when opening moves in a forwardly arc in the bed embodiment and in a rearwardly arc in the chair embodiment. The arc like path of both the bed pan and the seat insert compromises support surfaces adjacent to the commode hole rendering inferior occupant support in proximity to the opening. It also is evident that the occupant would have to change position so that body parts would clear the commode and insert devices when they are in motion. Access to the commode receptacle subsequent to use is partially obstructed in the chair embodiment by front chair legs and the legrest. In the bed embodiment the used commode is inconveniently located at the center of the bed, making the emptying of the same inconvenient. Schmitt's ring (n) which supports and surrounds the bed pan encumbers removal of the bed pan.

Prior art has not shown a device: 1) that employs an independently rotating seat insert, 2) that can operate in as confined a space as the present invention, 3) that provides occupant comfort equal to the present invention, 4) that allows the occupant to use the device without moving significantly, 5) that provides an easy means of emptying and reinserting a commode receptacle, 6) that provides for temporary storage of waste by reinserting the commode lid, 7) that provides means for keeping commode receptacle upright during rotation, and 8) that has a sufficiently low profile that it can be incorporated into folding articles of furniture. These features are, in part, objects and advantages of the present invention. Use of seat inserts has also been shown to be useful in devices known as kinetic beds for access to body parts. Raising or lowering one section of the seat with respect to another for medical purposes and for changing occupant positioning also represents a use of seat insert. Modifications of the present invention may also be employed to accomplish these purposes.

SUMMARY OF THE INVENTION

The present invention solves problems that prior art has not met. By employing an autonomously rotating seat insert in conjunction with a pivoting support arm, the present invention makes a smooth and near seamless transition from a substantially continuous support surface of a chair or bed type device to a support surface with an opening for a commode receptacle. It does so in a manner that is comfortable and unobtrusive for the occupant when either opening or closing, and when not in use.

The seat insert rotates counter clockwise with respect to its supporting arm when the supporting arm rotates clockwise. Contrariwise, the insert rotates clockwise when its supporting arm rotates counter clockwise. Such rotational movement of the insert, either as it joins or separates from the seat provides a smooth and comfortable transition. During rotation the insert, coming into its originating position with the seat, customarily leads with its forward edge. In the last stages of movement, the seat insert approaches perpendicular movement as it passes through seating support components such as cushions or transverse slats such as those of the parent application.

Independent rotational movement of the seat insert is especially desirable when a supporting surface is thick as in a mattress or springably movable as in lateral occupant supporting slats. Rotation and near perpendicular movement of the seat insert minimizes problems of surfaces binding as can be encountered when seating and bedding support surfaces such as cushions are deformed by weight of the occupant.

In articles of furniture such as wheelchairs and modifications thereof access and space constitute prodigious challenges. In the present invention, the movement path of the seat insert is compact and expeditiously gets the insert into position in a small amount of space. This allows commode and seat movement to occur in a relatively confined area. Moreover, in FIG. 1 it can be seen that absent the commode, the assembly has a low profile which enables it to fit within folding chairs or beds when not in use.

The commode assembly operates in conjunction with the seat insert assembly such that when the seat insert is up in its originating position, the commode is covered by a lid. When the commode moves downwardly, it travels through an arc that brings the commode to the side of the article of furniture. Mechanical means are employed to keep the commode in a substantially upright position. The disclosure shows how slats, a sheet of plastic material, and thin mattress can be employed with the insert to provide a comfortable support surface on devices that function both as chairs and beds.

The commode can be selected to pause in its movement cycle so that it can be emptied or alternatively so that it can be allowed to return to a position under the seat opening where it can be used for urination or defecation. By pressing a switch the commode can be cycled out of the way so that the seat insert returns to the seat hole and the commode is returned to its original inactive position.

All assembly movements can be controlled by two or fewer switches. A single switch can activate the assembly. The other switch can be employed to empty the commode.

BRIEF DESCRIPTION OF THE DRAWINGS

Methods in development and drafting used conventions of Design Cad 3-D (Tm), American Small Business Computers, Inc., Pryor, Ok.

FIG. 8*a*. Wiring schematic for commode and seat insert assembly having more space.

REFERENCE NUMERALS AND PART NAMES IN DRAWINGS

Figure 1:
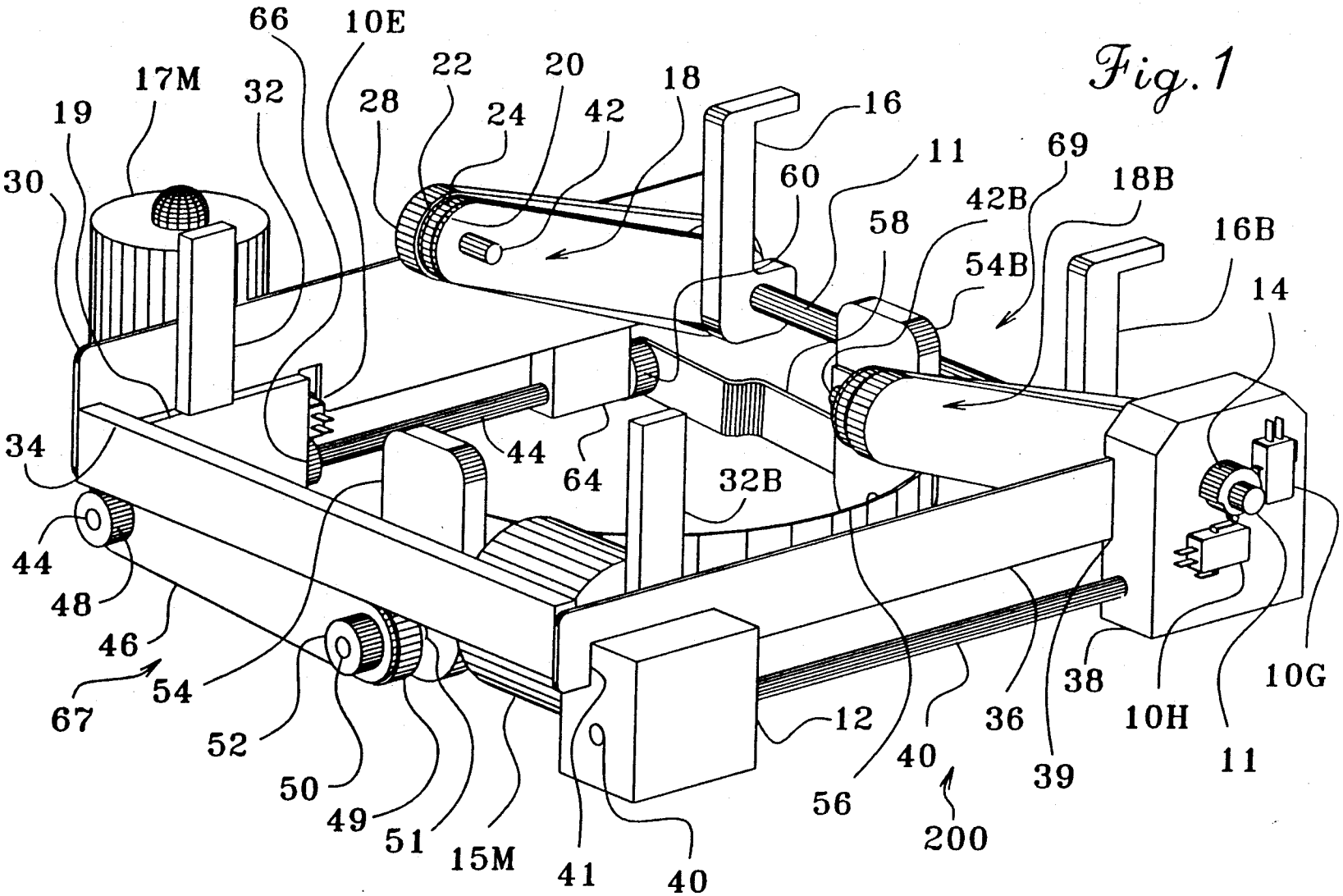
FIG. 1. Supporting seat insert arms and commode arms with components to actuate them. Horizontal angle 140 degrees, vertical angle 20 degrees.
Figure 8:
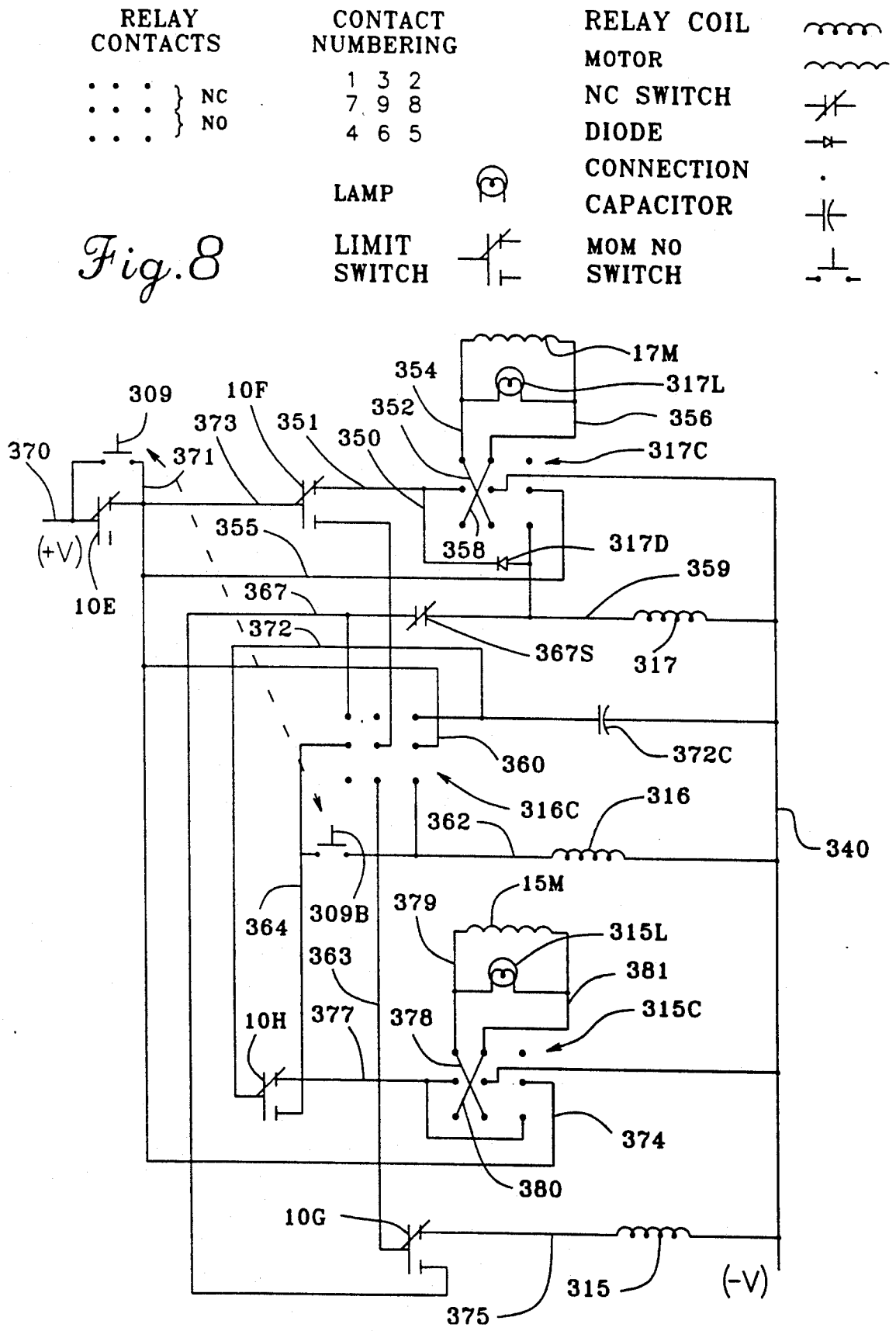
FIG. 8. Wiring schematic for commode and seat insert assembly in constrained space.

In the following "B" with a reference numeral refers to a second corresponding part of the same kind. "F" designates commode receptacle components in the outward position. Location numbers indicate approximate position of parts not shown. The following is a list of drawing reference numerals and part names separated by semicolons:

10E limit switch, commode top; 10F limit switch, commode bottom; 10G limit switch, seat insert top; 10H limit switch, seat insert bottom; 11 seat shaft; 12 seat motor gear box; 14 seat limit switch cam; 15M seat motor; 16 and 16B seat shaft holder and mount which serve as a supporting structure for the seat insert supporting means, 17M commode motor; 18 and 18B seat insert support arm; 19 commode motor gear box; 20 interior seat support plate of 18; 22 exterior seat support plate of 18; 24 upper seat support arm spacer of 20 and 24; 26 lower seat support arm spacer of 20 and 24; 27 seat insert chain; 28 seat support arm chain cover of 22; 30 right side support; 31 lower aperture and hole for sprocket in chain cover 28; 32 and 32B front mount; 33 upper aperture for sprocket in chain cover 28; 34 front side crosspiece; 35 groove for chain in chain cover 28; 36 left side support; 38 gear reducer and mounting box for large worm and seat worm wheel; 39 slot in gearbox 38; 40 seat drive shaft; 41 groove in gear box 12; 42 and 42B seat insert supporting shaft; 43 commode chain; 44 commode drive and support shaft which serves as a first rotating means connected to the article of furniture; 45 rotatable commode sprocket; 46 supporting and driving commode arm; 47 stationary commode sprocket; 48 support cylinder of 46; 49 chain cover of 46; 50 rotatable commode shaft;

51 spacer of 54; 52 stabilizing cylinder of 46; 53 interior aperture and hub for sprocket in chain cover 49; 54 and 54B commode receptacle holder; 55 exterior aperture and hole for sprocket in chain cover 49; 56 commode receptacle linkage; 57 groove for chain in chain cover 49; 58 dog leg commode support arm; 59 commode shaft, rear; 60 support cylinder of 58; 62 stabilizing cylinder of 58; 64 support block for commode shaft 50; 67 commode assembly comprising components serving to move and position commode 106; 66 limit switch cam for commode shaft 50; 69 seat insert assembly comprising components serving to move and position seat insert 70; 70 seat insert; 71 seat insert cushion if alternatively rotated on a single axis; 72 movement path for rear of seat insert 70; 73 movement path for rear of seat insert 71 if alternatively rotated about a single axis; 74 movement path for front of seat insert 70; 75 movement path for front of seat insert 71 if alternatively rotated about a single axis; 76 cushion of 70; 78 cushion support plate; 80 insert supporting shafts; 82 shaft mounting blocks; 84 insert supporting springs; 86 shaft stops; 88 shaft guides; 89 commode lid position if rotated about a single pivot; 90 commode receptacle lid; 91 commode receptacle handle; 92 lid movement limiter; 94 insert base mounting plate of 70; 96 insert mounting crosspiece of 70; 98 vertical crosspiece mounting member of 70;

100 rotatable seat insert sprocket referred to as a second sprocket B; 102 stationary seat insert sprocket referred to as a first sprocket A; 104 lid support shaft; 106 commode receptacle; 108 side cut in commode receptacle; 112 rear crosspiece; 116 location outside retaining ring and interior washer (not shown); 118 location hole (not shown) in side support 30; 120 location for washer (not shown) between sprocket 102 and seat arm 18; 122 location for washer (not shown) between seat arm 18 and holder 16; 124 location interior washer and exterior retainer ring (not shown); 126 interior of shaft holder 16B; 130 front crosspiece; 132 aperture in side 30 for limit switch; 134 groove in gearbox 19; 138 and 138B seat shaft guide for shortened seat slats, rear; 140 and 140B seat shaft guide for shortened seat slats, front; 142 and 142B longitudinal support; 144B aperture in longitudinal support 142B to accommodate shaft 42 when in uppermost position; 146 slat; 148 nub on slat with hole for small hitch pin to connect plastic cover;

150 shafts with springs (not shown) to support slats; 152 shortened slat to allow for insert 70; 154 middle shortened slat; 156 supporting plate; 160 shortened shaft; 162 shaft with nub, washers and retaining rings, springs (not shown); 164 slot to allow leg rest pivot adjustment; 166 slat connected to legrest so that effective length of seat may be altered; 168 rotational slat insert support, acetal plastic, with slidably mounting hole on shaft 146; 170 front leg; 171 air vents; 172 belt slots for attaching to slats where belt has sufficient length to provide longitudinal movement; 174 snaps to attach to cushion having approximately same dimensions as plastic cover; 176 hole for commode opening; 178 attachment point for rubber belt attached at top of plastic cover and under cushion connecting to legrest; 180 hole in which nub on seat slat fits and attaches to slats; 182 plastic cover for slats;

200 sub assembly of commode assembly and seat insert assembly; 202 commode assembly and seat insert assembly, with mounting supports; 236 seat; 278 side member of legrest; 280 member; 300-399 electrical components FIG. 8; 400-499 electrical components FIG. 8*a*.

DESCRIPTION OF THE PREFERRED EMBODIMENT, FIGS. 1 TO 13

Figure 2:
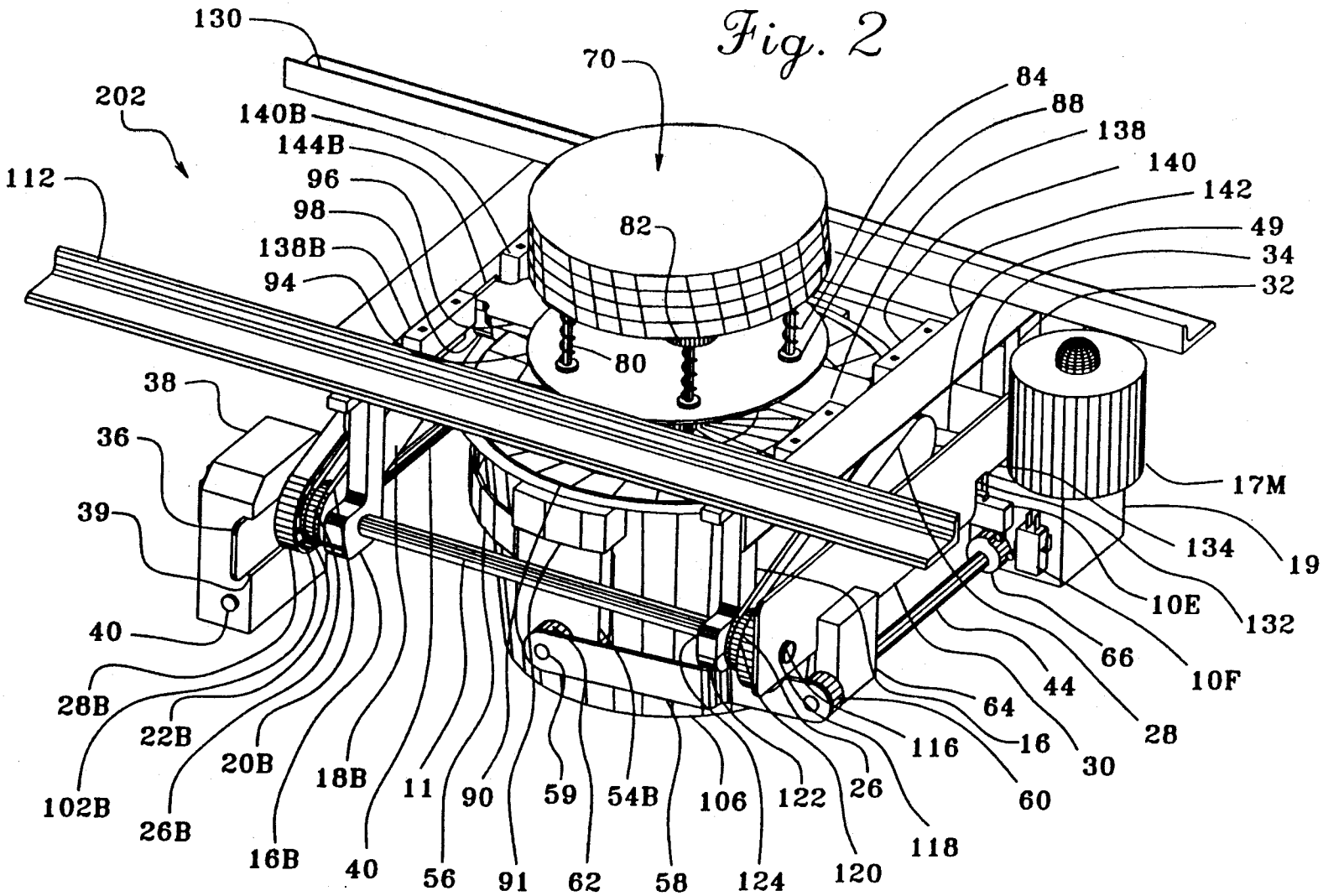
FIG. 2. Commode and seat insert assemblies as attachable to seat members. Commode and seat insert assemblies are shown before movement. Horizontal angle-60 degrees, vertical angle 30 degrees.
Figure 3:
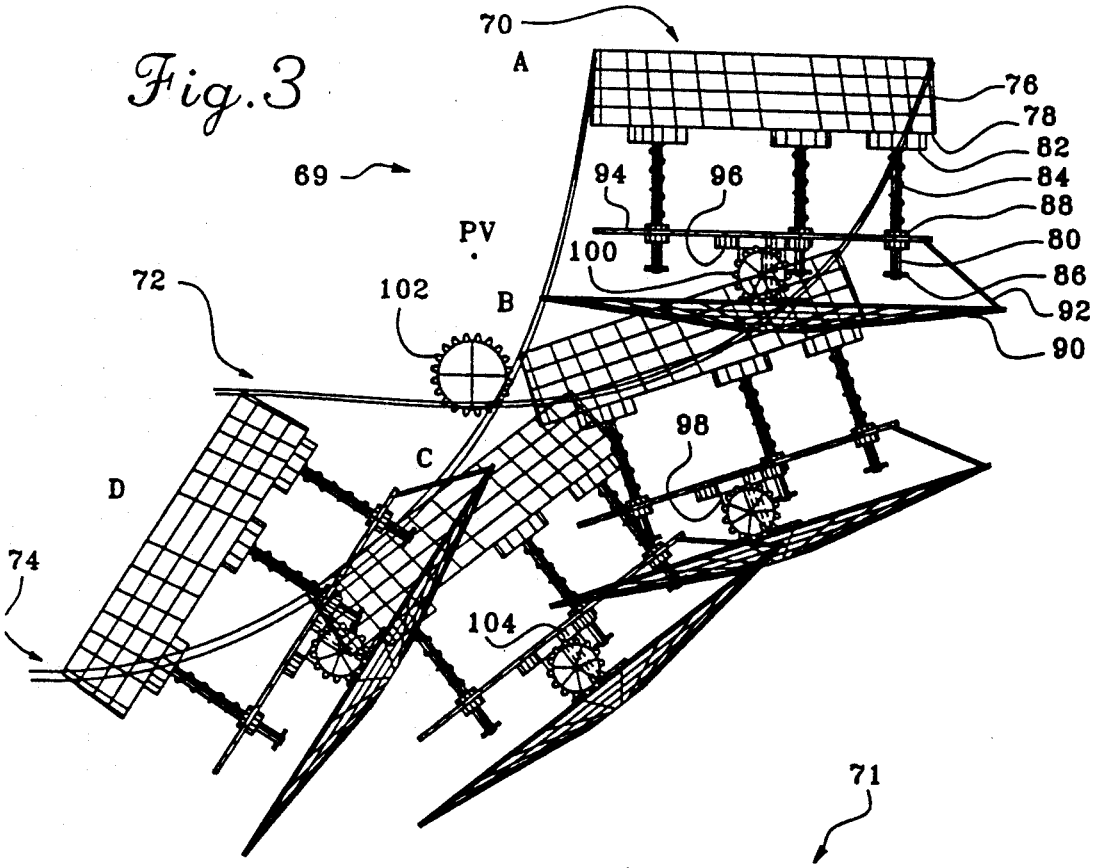
FIG. 3. Diagrammatic view of seat insert assembly during rotation shown in wireframe form based on a 3-D representation without hidden lines. Horizontal angle 0 degrees, vertical angle 0 degrees.
Figure 4:
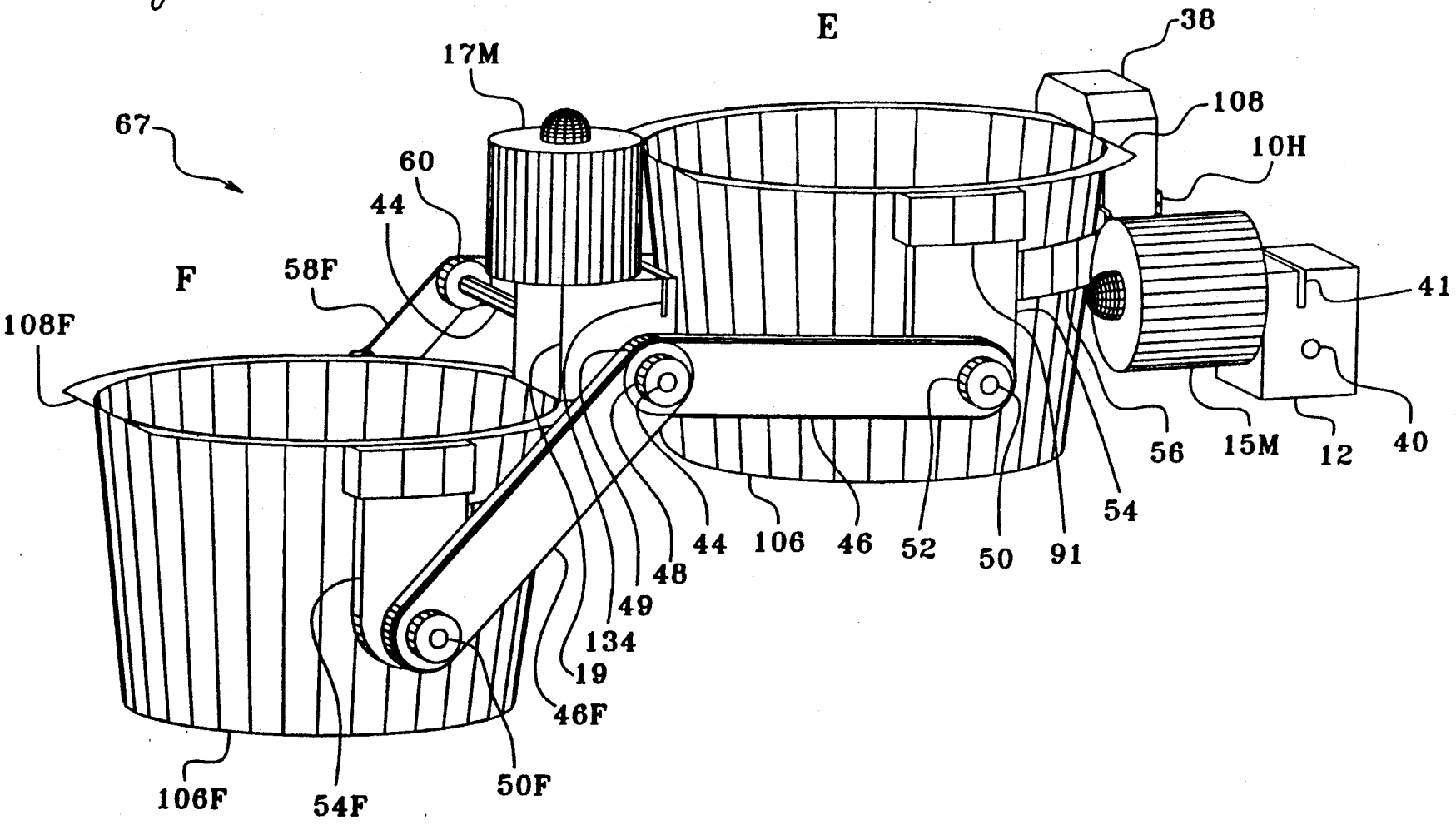
FIG. 4. Commode assembly showing commode receptacle shown extended outwardly and in inward position "E". Motors and gearboxes are shown. Majority of other components not shown. Horizontal angle 70 degrees, vertical angle 10 degrees.

As shown in FIG. 1 and 3, the commode 67 and seat insert assembly 69 embody mechanical means for inserting and removing a seat insert 70 from seat support surfaces in articles of furniture. Positioning of the commode 106, FIGS. 2 and 4, is accomplished by mechanical means (supporting assembly 202) so that commode 106 can be moved to alternate positions where it may be used for urination or defecation; emptying; or inactive positioning.

Figure 5:
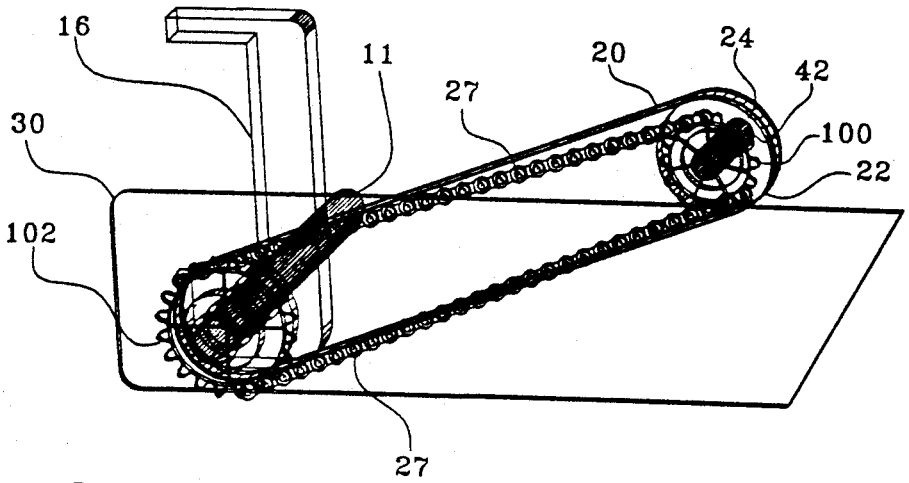
FIG. 5. Cutaway view of interconnection of sprockets and chain on seat insert support arm. Cutaway of chain at opposite ends reveals sprockets. Horizontal angle 15 degrees, vertical angle 15 degrees.
Figure 6:
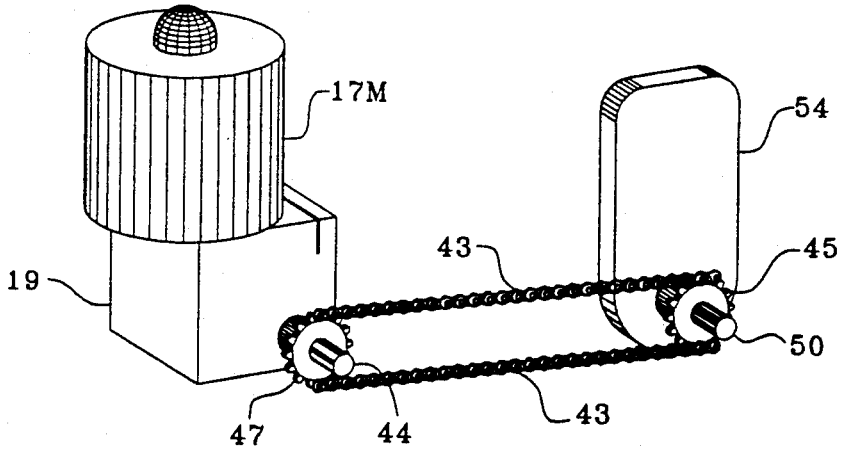
FIG. 6. Cutaway view of stationary and rotating commode sprocket with motor and commode holder. Cutaway of chain at opposite ends reveals sprockets. Horizontal angle 60 degrees, vertical angle 20 degrees.

As illustrated in FIGS. 1, 2, and 5 seat insert support arm 18 comprises upper 24 and lower 26 seat support spacers. Interior 20 and exterior 22 support plates in conjunction with seat support spacers 24,26 are components of seat insert support arm 18. Arm 18 provides a relatively light weight and strong supporting means for seat insert 70. The lower end of seat insert support arm 18 is connected to seat shaft 11 by means of keyway so that arm 18 does not rotate about shaft 11. Configuration of seat support arm 18B and its attachments mirror seat support arm 18 and together provide strength to support seat insert 70.

Keyways, as referred to herein, are pressed into shaft slots and are fitted into a keyway slot in a hole of the item mounted to the shaft. A keyway cutter was used to cut the slot in the shaft and a keyway broach and bushing were used to cut the slot within the hole as is commonly done. These methods were used when connections were made by keyway. When longitudinal stabilization a shaft was required retainer rings or metal roll pins were used to additionally stabilize the connection. Specificities in the disclosure with respect to keyway, sprocket, gear, and chain sizes and choice of materials reflect a practical embodiment of the invention and should not be construed as limitations of the disclosed invention. In a practical embodiment of the invention #3 size $\frac{1}{8}'' \times \frac{1}{2}''$ Woodruff keys part number 3877 Au-veco, Covington, Ky. were customarily used.

Shaft 11 is rotatably connected at a first point of rotation to shaft holder and mount 16. Shaft 11 passes through and turns on an axis within a hole in holder 16. Shaft 11 is rotatable on an axis in a bushing within shaft holder 16 which is connected to rear crosspiece 112, which is connected to seat member 280, which in turn is connected to the article of furniture. The shape of shaft holder and mount 16 is in part in the form of an inverted "L" to allow passage of linking means such as chain numerated 158 in the parent application. The "L" shaped opening allows the commode and seat insert assembly 200 to move forwardly or rearwardly without obstructing stationary frame members such as said chain. Shaft holder 16 is located in close proximity to seat insert supports arm 18 to provide optimum support for loads on arm 18.

Referencing FIG. 2, parts located on shaft 11 occur in the following sequence: a retaining ring and outside washer are located at position 116, to hold shaft in position with respect to side support 30; a hole 118 in side support 30 within which shaft 11 can rotate; hub of sprocket 102 is screwed to side 30; a hole 31 in chain cover 28 attached to arm 18 overlaps the hub of sprocket 102 and an aperture 31 within chain cover 28 houses sprocket 102; a washer at location 120 to provide spacing between sprocket 102 and seat arm 18; a washer at location 122 between seat arm 18 and holder 16; holder 16; and an interior washer and exterior retainer ring at location 124. In mirror fashion corresponding parts are located from shaft holder 16B at position 126 to side support 36.

Within an aperture of gear reducer box 38 a large worm gear wheel (typically a right hand, 14.5 degree pressure angle, cast iron, 30 tooth, #12 pitch, stock worm gear Browning (Tm), Maysville, Ky., not shown) is attached to shaft 11 by keyway. Shaft 11 passes through and rotates within gear reducer box 38. Limit switch cam 14 with detent is attached to shaft 11 by keyway to define range of motion for shaft 11 and arms 18 connected thereto. Limit switches 10G and 10H read the detent in cam 14 and are used to control motor 15M which drives shaft 11 subsequent to gear reductions in gear boxes 12 and 38.

Side 36 fits within a groove 41 in gearbox 12 and within a slot 39 in gear box 38. Both gear box 12 and 38 are screwed to side 36. Torque from arms 18 is transferred to side 36 through gearbox 38. The connection of side 36 to front mount 32B, which is connected to longitudinal support 142 connected to crosspiece 130, serves to hold the arm 18 in position when a downward load is put on arms 18. Torque originating from shaft 42 in response to insert 70 loads are transferred by chain 27,27B from sprocket 100,100B to sprockets 102,102B to sides 30,36 where it is stabilized by mounts 32,32B.

Chain 27 linkably connects insert 70 to sides 30,36 and thereby links insert 70 to the article of furniture. Connecting means indirectly connect sides 30,36 to the article of furniture by means of holders 16, mount 32, crosspieces 112,130, longitudinal support 142, and seat 280. Mounts 32,32B may alternately incorporate a flexible or spring-like support to provide cushioning for insert 70. In FIG. 1 side 36 is shown to be connected to front side crosspiece 34 which is connected at its opposite end to side 30. Crosspiece 34 serves to maintain perpendicularity of sides 30 and 36.

Referring to FIG. 1 seat motor 15M serves as a rotating driving means and is connected to gear box 12 Within gear box 12 a worm connected to motor 15M shaft engages with a 40 tooth single thread worm wheel fixedly connected to shaft 40 by keyway. At opposite ends of shaft 40, shaft 40 is stabilized against longitudinal movement by retainer ring and washer abutting gear boxes 12 and 38. Within gear reducer box 38 a #12 pitch worm connected by shaft 40 to gear box 12 engages with a 30 tooth single thread #12 pitch worm wheel. Gear reducer 38 in combination with gear box 12 thus provide two stage gear reduction of 1200 to 1 ($1200=40\times30$) to drive shaft 11, a 40 to 1 reduction in the first stage and a 30 to 1 reduction in the second stage.

Use of worm gearing within gear reducer box 38 is advantageous because worm gearing is resistant to being back driven. Thus, once arms 18,18B are in position they do not inadvertently change in response to seat insert loads. Because of potentially high loads or unforeseen shocks, large diameter worm gearing in gear box 38 is preferred. The gear teeth need not be cut for a full 360 degree rotation, as they are in a practical embodiment, since rotation is normally less than 180 degrees.

Functionally gearing may be located wherever drive components do not interfere with the article of furniture or commode and seat assembly components. Positioning of motor 15M and components of gear box 12 or positioning of motor 17M and gearbox 19 are readily alterable in other embodiments of the invention. Drive components can be located at many points at right angles to shafts 11, 40, or 44. Component positioning also can be modified by using spur or helical gear reduction. Methods of gear reduction are widely alterable and known.

Figure 7:
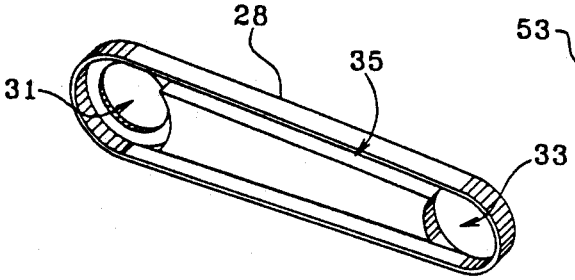
FIG. 7. View from underside of seat support arm chain cover and commode arm chain cover. Seat support arm chain cover shown at 40 degrees horizontal, 35 degrees vertical.
Figure 7A:
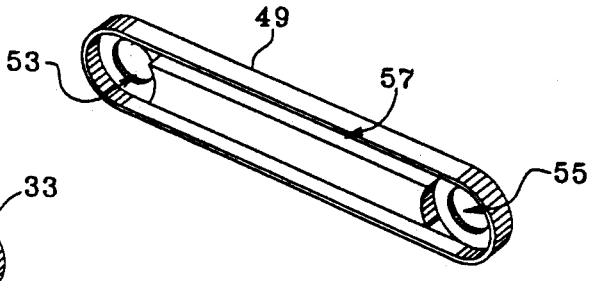
FIG. 7*a*. Commode arm chain cover shown at 35 degrees horizontal, 35 degrees vertical.

FIG. 3 shows sear insert 70 in rotation as arm 18, FIG. 1, rotates. Seat insert 70 is shown in originating first position "A" and rotated in remote positions "B", "C", and "D". Positions "A, B, C, D" indicate approximate path and angle of insert 70 during movement. With reference to FIG. 1 together with FIGS. 3, 5, and 7 at upper end of arm 18, shaft 42 is fixedly attached to sprocket 100 which resides within an aperture 33 in seat support arm chain cover 28. Shaft 42 passes through a hole with a bearing in seat arm 18 and during movement rotates within said hole in arm 18. At the interior end, shaft 42 is fixedly attached to vertical crosspiece mounting member 98 by keyway. Thus sprocket 100, shaft 42 and vertical member 98 are rotatable together as a single unit and serve as a second rotating means for seat insert 70 about supporting means 18 at a second point of rotation. Sprocket 102 is attached to right side support 30 and does not rotate. Sprocket 102 serves as a substantially stationary means to define the rotation of sprocket 100. Sprocket 102 is linked to sprocket 100 by chain 27, FIG. 5, such that center distance between the two sprockets is at maximum allowable distance so that substantial slack does not occur in chain 27. Chain 27 fits within groove 35, FIG. 7, of chain cover 28.

Sprocket 102 is shown with 20 teeth and sprocket 100 is shown with 14 teeth. The amount of rotation in seat insert 70 may be changed to suit design needs by varying the gear ratio between sprocket 100 and 102. The rotation of said seat insert 70 appears to be explained by the formula $RT=R\times S$ where $R=(A-B)/B$, where S equals the degree of rotation of supporting arm 18, where A equals the number of teeth in sprocket 102, where B equals the number of teeth in sprocket 100, and where RT approximates the degree of rotation of the seat insert 70 with respect to its originating position. "R" is term of convenience used to indicate the number of rotations in sprocket "B" if an arm, analogous to arm 18, between sprockets "A" and "B" were rotated through a full 360 degrees.

Based on the formula $RT=R\times S$ where $R\times(A-B)/B$ if arm 18 were rotated clockwise 135 degrees ("S") and "A" of 20 teeth were held stationary, "B" of 14 teeth would rotate counter clockwise approximately 57.8 degrees. For example $RT=(20-14)/14\times135=57.8$. The formula is believed to describe the rotational relationship, but it is not intended to be binding or necessarily limiting on the scope of the invention. The formula is a general expression that is useful in the practice of making an embodiment of the invention.

It can be seen from this formula that as the number of teeth in sprocket 100 approach the number of teeth in sprocket 102 the movement of insert 70 becomes increasingly perpendicular. The relationship between sprocket "A" 102 and "B" 100 determine the angular rotation of insert 70 and its direction of rotation and thus are useful making embodiments of the invention.

It can be generally seen with reference to FIG. 3 that changes in maximum center distance allowable between sprockets 100,102 at different arm 18 and chain 27 lengths and alteration is sprocket sizes could be adaptable to a wide variety of space constraints and commode and seat insert configurations. It can be understood from FIG. 3 that various shaft 80 lengths and degree of arm 18 rotation similar alterations in component dimensions and movement distances would also alter seat insert path 72,74. It is pointed out that if cushion 76 were to come in contact with shaft 11, cushion 76 is often sufficiently pliable that operation is not impeded.

Figure 3A:
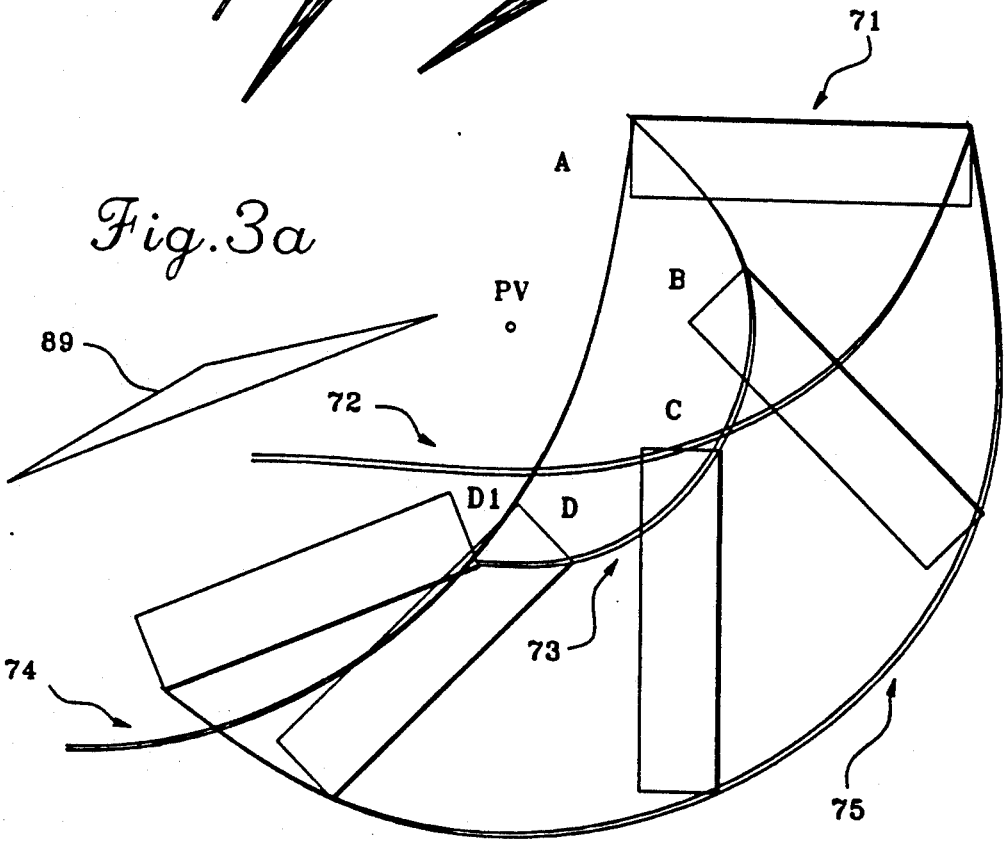
FIG. 3*a*. A representation of an alternative method of movement of a seat insert about a single pivot point.

FIG. 3*a* illustrates an alternative method for rotating insert 71. Paths 72,74 are identical to seat insert paths of the present invention shown also in FIG. 3. Paths 73,74 respectively hypothetically indicate means of seat insert rotation defined about a single pivot "PV" (also shown for reference in FIG. 3). It can be seen by alternative paths 73,75 and insert 71 at positions "A,B,C,D,D1" that at uppermost positions path 73 has sharply horizontal movement inviting pinching and rubbing. This is not desirable for occupant comfort or for passing through thick/deformed cushions. Change in seat angle at positions "A" to "B" is more abrupt in FIG. 3*a* than FIG. 3. Similarly insert 71 must go through of great angular changes. The path of lid 89 also goes through greater tilting and occupies more space. It can also be seen that additional rotation as shown by position "D1" is needed to get insert 71 out of commode path.

It is known that a circle can be defined by 3 points on a circumference. By taking 3 points on path 74, it can be found that path 74 approximately represents an arc with a radius 2.5 times the radius of the arc of path 73 (the center of the arc approximating path 74 being at approximate seat level). This implies that when using a single pivot a much larger apparatus with greater overhung loads would generally be required in order to achieve the approximate perpendicularity effect of an embodiment of the present invention which uses 20/14 gearing at sprockets 102,100. Static space constraints of chair/bed components and dynamic considerations of interaction with moving commode parts thus augur against employing a single pivot to position seat insert 70. This disclosure teaches that 73,75,71 seat insert positioning is inferior to insert 70 rotation illustrated in FIG. 3 although the deficient version could be employed in a less desirable embodiment of the invention.

In FIG. 3 the lower section of insert 70 comprises an insert base mounting plate 94 which is fixedly attached to the thicker insert mounting crosspiece 96 which gives mounting plate 94 increased strength and rigidity. Vertical crosspiece mounting member 98 is attached to shaft 42 by keyway and by extension is linked to sprocket 100 which is mounted to the other end of shaft 42. Sprocket 102, sprocket 100, chain 27, shaft 42, and vertical mounting member 98 serve as a means for angularly positioning insert assembly 70 about shaft 42.

Lid support shaft 104 is attached near the midpoint of insert mounting crosspiece 96 such that when shaft 104 is attached to commode receptacle lid 90 the lid is centered on and suspended above commode receptacle 106 in its inward "E" position. Lid movement limiter 92 is an optional cable which may be employed to prevent lid 90 from becoming misaligned and catching on commode receptacle 106 as it moves downwardly. It is attached to holes in base mounting plate 94 and lid 90. If desired, clearance between lid 90 can be increased by increasing gear ratio between sprocket 102 and 100 or by increasing rearward movement of insert support arm 18.

Insert supporting shaft 80 is pressfitted into shaft mounting block 82 which is attached to rounded wooden cushion support plate 78 approximately ⅜" thick. Foamlike cushioning material is used within cushion 76 and cushion 76 is detachably connected to plate 78. The connection is customarily made by an elastic band (not shown) within cushion 76 cover which pulls the cover inwardly close to shaft mounting block 82 in a manner closely analogous to a hair net pulling inwardly at its base. Cushion 76 may also be attached by Velcro (Tm)-like fasteners, snaps, and numerous other known methods.

Five equidistantly mounted supporting shafts 80 are employed with the forward shaft 80 being at an approximate midway point on plate 94. This arrangement of shafts is desirable to provide comfortable support with ability to assume a slight rearwardly or sideways angle depending on load so as to conform to the occupant. Spring 84 rests on a washer on top of plastic shaft guide 88 which is vertically supported by mounting plate 94 and axially rotatable on plate 94. Shaft guide 88 has a subtly oval hole within which shaft 80 may move slightly forwardly or rearwardly so as to prevent binding during misalignment or angular tilting of insert 70. Shaft guides 88 serve to reduce metallic rubbing noise which otherwise tends to result of shaft 80 moves within a simple hole in mounting plate 94. Shaft guides 88 are not required and insert 70 will function with simple holes in mounting plate 94 at locations 88.

In FIG. 3 shaft 80 is shown in exaggerated length to show shaft stops 86 comprising a washer held in place by a retainer ring to limit upwardly movement of insert 70 when no load is present. Shaft 80 length is normally computed such that when spring 84 is at solid height shaft 80 does not protrude into lid 90. Spring 80 responds to load and provides a comfortable support surface on insert 70 to blend with a seat in an article of furniture.

FIG. 4 in conjunction with FIGS. 1, 2, 6, and 7*a* illustrates commode assembly 67 construction and operation. Position "E" refers to the inward position. Commode receptacle 106 as shown in commercially available. Commode handles 91 loosely fit over commode receptacle holders 54 and 54B and allow commode receptacle 106 to be placed on holders 54 when in outwardly position designated by "F" in FIG. 4. On Shaft 50 from the inside out: commode holder 54 is attached by keyway to shaft 50; a spacer 51 on shaft 50 distances holder 54 from chain cover 49; sprocket 45 firmly attached to shaft 50 resides within an aperture 53 in chain cover 49; the hub of sprocket 45 loosely fits within the hole 53 of chain cover 49; shaft 50 passes through a bushing in commode arm 46 and stabilizing cylinder 52 which is fixedly attached to commode arm 46 with shaft 50 customarily held in position by an outside retainer ring (not shown). Commode arm 46 serves as a means between first and second rotating means for commode assembly 67 which supports holder 54. Shaft 50 thus can rotate in conjunction with commode holder 54. Shaft 50 serves as a second rotating means for commode assembly 67. A bent metal commode receptacle linkage 56 is fixedly attached to support 54 and 54B and passes around commode receptacle 106. Holder 54B is rotatably connected to fixed rear shaft 59 which is mounted to stabilizing cylinder 62 which is fixedly attached to support arm 58 having a dog leg bend to allow arm 58 to clear commode receptacle handle 91 and seat arm 18 when they are in downward positions. The rotation of holder 54B is determined by its linkage with holder 54.

In the following order: The hub of stationary sprocket 47 is fixedly attached to commode motor gear box 19. Chain cover 49 has a hole 55 through which the hub passes and an aperture 55 to accommodate sprocket 47 and 45. Chain 43 is tightly in contact with sprocket 47 and fits within groove 57 of chain cover 49. Within sprocket 47 a bushing allows shaft 44 to freely rotate at the center of sprocket 47. Commode arm 46 is fixedly attached to support cylinder 48 and shaft 44 is attached to cylinder 46 by keyway. Shaft 44 serves as a first rotating means for commode assembly 67 and is connected indirectly to the article of furniture via connection to side 30 which is connected to mount 32 and shaft 11 said connections serve as commode assembly 67 supporting means and are traceable back to the article of furniture.

At the opposite end of shaft 44 cylinder 60 is fixedly attached to commode arm 58 and cylinder 60 is attached by keyway to shaft 44 so that commode arms 46 and 58 are substantially parallel. Support block 64 stabilizes one end of shaft 44 and allows shaft 44 to rotate within block 64. Gear box 19 supports the other end of shaft 44 and provides rotational movement to actuate the assembly 67.

Sprocket 47 and 45 are located on arm 46 at maximum center distances allowed by chain 43 so that chain 43 remains taught. Since sprockets 47 and 45 have the same number of teeth and are linked by chain 43, the commode holder 54 which is fixedly linked to sprocket 45 remains vertical. Since holder 54B is joined to holder 54 by linkage 56, it too remains continuously vertical.

In a practical embodiment employing stock worm gears in gear box 19, shaft 44 is driven by a two stage 20 to 1 worm gearing at each stage producing a total reduction of 400 to 1. It will be recalled that the gear reduction at shaft 11 is 1200 to 1. When seat insert 70 opens the faster movement of commode arm 46 allows commode 106 to quickly get out of the way of arm 18 when arms 18 and 18B move simultaneously with arms 46,58. Opposing sides of commode receptacle 106 are cut at 108 to eliminate interference between commode 106 and arm 18 during movement. The amount of gear reduction is a design choice which may be altered to suit various embodiments of the invention.

Limit switches 10E and 10F are employed to read the detent in commode limit switch cam 66 which is connected by keyway to shaft 44 and which defines the range of movement of shaft 44. Cam 66 and limit switches 10E and 10F are employed to control motor 17M which positions commode 106 in a range of positions as indicated by FIG. 4.

Figure 9:
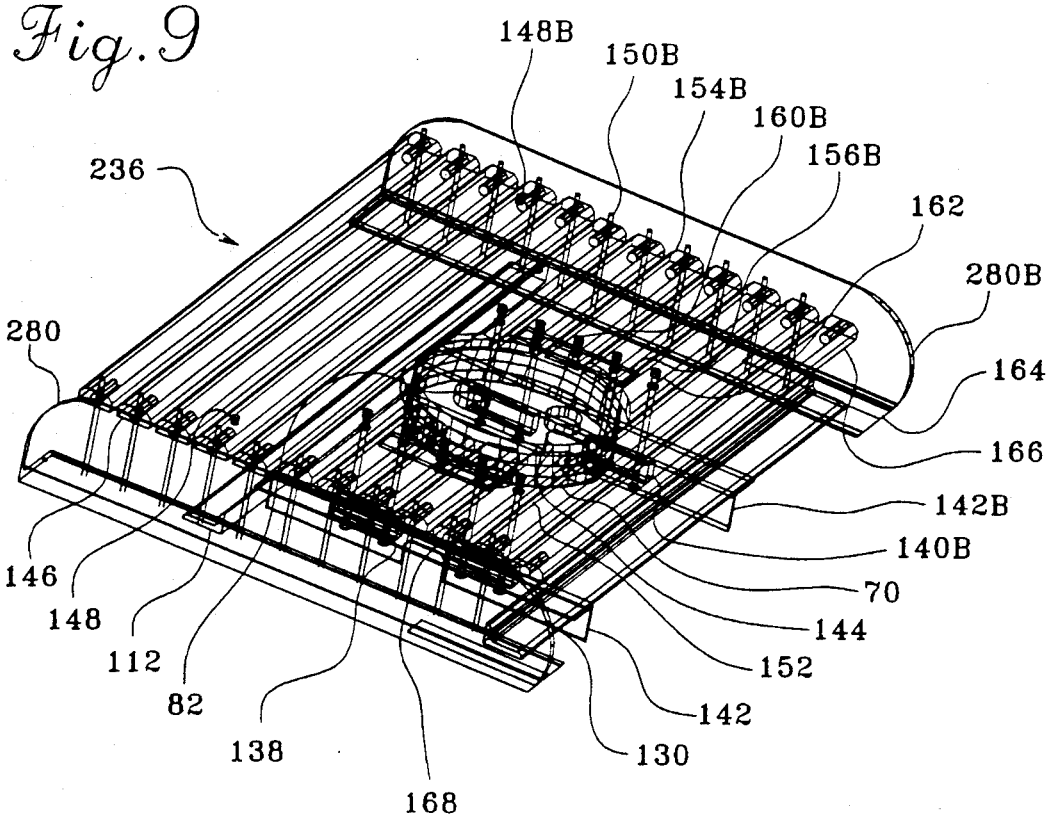
FIG. 9. Perspective view of seat assembly in wireframe form.
Figure 9A:
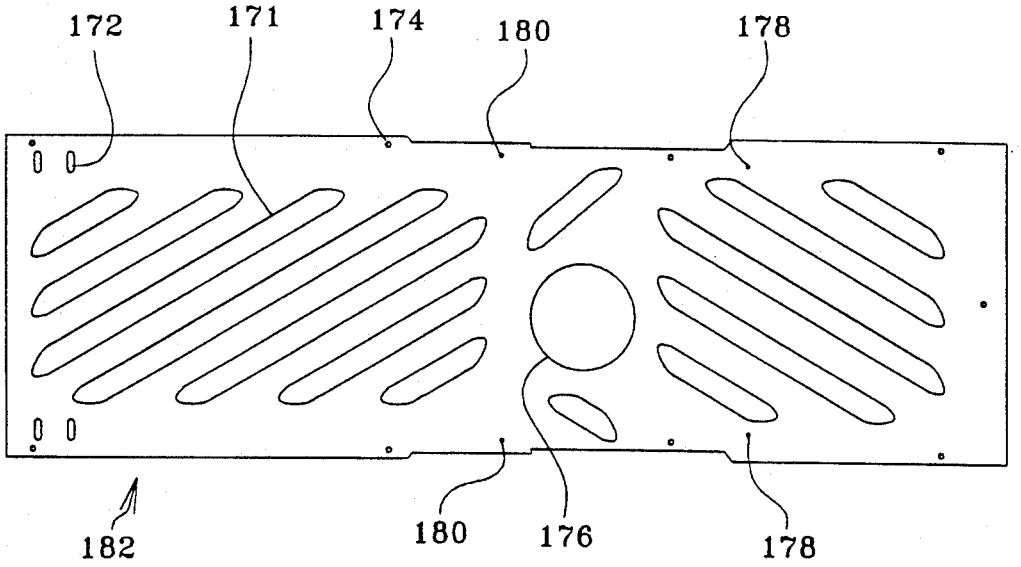
FIG. 9*a*. Plastic cover for seat slats. 0 degree horizontal, 90 degrees vertical.
Figures 10, 11, 12, 13:
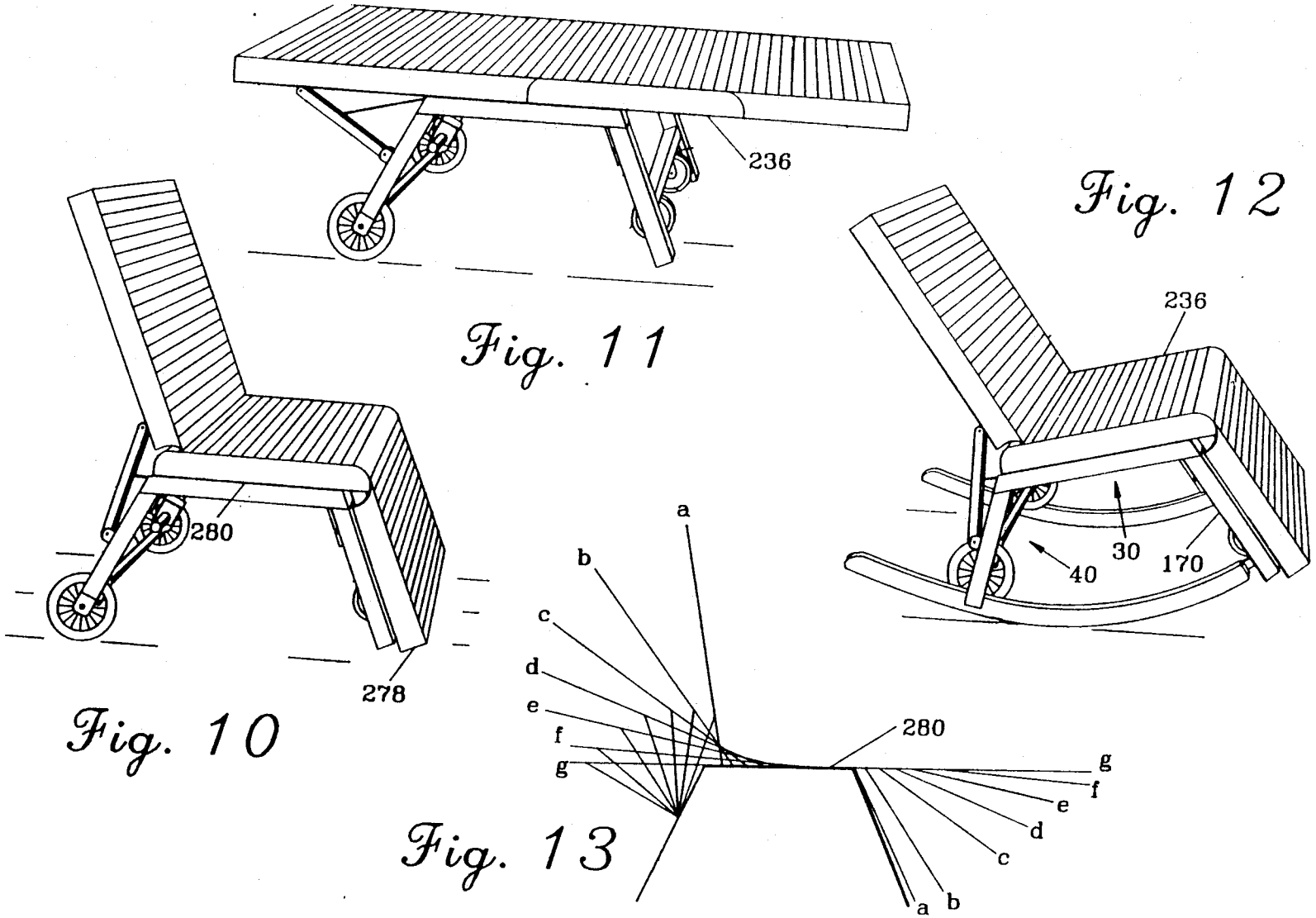
FIG. 10. A perspective side view of the chair with rear wheel extended.
FIG. 11. A perspective side view of the chair with rear wheel extension.
FIG. 12. A perspective side view of the chair of FIG. 10 in a rocking configuration, with front rocker arm extended and wheel assembly retracted.
FIG. 13. A kinematic stick drawing of changing back, seat, and legrest positions at equal intervals of seat movement.

Placement of seat insert assembly components within a seat of an article of furniture can be understood by consideration of FIG. 2 along with FIG. 9. The location of crosspieces 112,130, the location of longitudinal supports 142,142B and seat insert 70 establish the positioning of components with respect to seat member 280 and seat 236 (numerals 280,236 being consistent with the parent application). FIGS. 10,11,12,13 in part from the parent application show seat member 280 and 236 in an article of furniture.

Plastic cover 182 approximately $\frac{1}{8}$" thick, pliable, but sufficiently firm that it masks unevenness at points between slats and at points of articulation when a backrest and legrest change position as in the parent application and minimizes shearing forces on the occupant during changes in backrest and legrest position. With respect to the commode opening, cover 182 particularly minimizes angular misalignment of shortened slats 152 which might otherwise lead to occupant discomfort. Cover 182 is detachably connected by small hitch pin to nub 148. It is slidably connected by a lose plastic belt at position 172 to slats at upper portion of cover and flexibly attached by rubber belt at 178 to the lowest portion of the legrest, said rubber belt being of the approximate consistency of material associated with a bicycle innertube.

Changes in positioning of shafts 11 and 44 with respect to height and angle are a natural outgrowth of the present disclosure and are particularly suited for various chair configurations and user requirements. Commode assembly 67 for example may be constructed in another embodiment so that it is located at a position that would constitute it having been rotated about a vertical axis at the center of commode 106 at position "E", FIG. 4. Positioning of mounting means for shaft 44 would thus effectively changing the outward position "F". This may be desirable in embodiments which require that the commode 106 path be altered to avoid obstructions posed by components of the article of furniture. Similarly supporting components for seat insert assembly 69 may be located at different positions and angles in other embodiments of the invention.

Except for commercially available stock parts, the vast majority of parts are made on a lathe or CNC milling machine using common techniques. Attachment of parts and assembly principally involves screwing pieces together where one piece has a hole and the other piece is tapped or occasional pressfitting of parts by common techniques. In rotatably or slidably connected/attached parts a shaft fits within a hole so that it may rotate or slide.

In a practical embodiment 6061 aluminum was employed in most parts made of plate, angle, or bar stock including support plates 20,22 and spacers 24,26; support 30, linkage 64, and shafts are generally stainless steel, gear boxes and chain covers and crosspiece 34, support block 64 of acetal or UHMW plastic. Shaft 80 is made of 0.187 Dia. stainless steel rod. In a practical embodiment #25 roller chain and mating sprockets of the same #25 size on arm 18 and commode arm 46 are used. #24 pitch worm gears and worm wheels are used in gear box 12 and 19. Standard gear hubs may be machined where required to meet space constraints. Additional protective covering and increased dimensions of sides 30, 36, 34 may be employed for purposes of safety. Standard miniature type snap action roller switches as available from numerous suppliers were used as limit switches.

Herein and in the claims, the terms rotation and points of rotation are defined to refer to the broad concept of rotation or revolving such as movement in a cycloidal path, eccentric rotation, movement in an elliptical path, or a revolution or orbit-like path about an approximate or fixed axis.

Commode receptacle 106 shown is commercially available, modifications thereof to make the pail more oval-like thereby increasing the front to back size of the commode hole are anticipated. Substitution of commode receptacles such as lightweight versions of small commodes of the kind found in yachts and pleasure boats may be employed using means disclosed herein. Such devices are advantageous for sanitation and for long term storage of waste. It is anticipated that various devices will be employed to direct waste matter and protect cushion of chair/bed supporting surfaces.

OPERATION-FIGS. 1, 2, 4, 8, 8A

The present invention serves to 1) form an opening within a seat of an article of furniture and to make a commode receptacle 106 available to the occupant so that it may be used for urination or defecation; and 2) to return insert 70 to fill the opening and locate the commode in a suitable storage location.

The present invention performs these operations in an expeditious manner that is comfortable for the occupant and conveniently provides for temporary storage and removal of waste. Cushioning 76 in combination with springable 84 support 80 provides a surface that comfortably blends with the seat of an article of furniture. In motion approximate perpendicularity of movement when seat insert 70 is in the vicinity of its originating position makes periods of transition comfortable for the occupant. Positioning of commode 106 in position "E" to be used, and in position "F" to be emptied is performed by means which keep the commode vertical.

Operation is controlled electrically by means typified by FIG. 8. The circuit is controlled by two switches 309, 309B and 367S. Double throw momentary switch 309, 309B activates the system either for opening or closing. Single pole switch 367 serves to interrupt the cycle so that commode 106 may be emptied or repositioned on holders 54, 54B. Limit switches 10E, 10F, 10G, 10H, as seen in FIG. 1, 2, and 8, have a normally closed and normally opened component. The normally closed component remains closed when it is within the cam 66, 14 detent and opens when it reach the limit of the detent. In the schematic shown in FIG. 8 there are 3 relays, characteristically 12VDC. Relay 317 coil controls commode motor 17M via its contacts 317C. Relay 315 coil controls seat motor 15M via its contacts 315C. Relay 316 coil via its contacts 316C and aided by 250 MF 50 VDC capacitor 372C on transition of limit switch 10H serves to latch the circuit to return seat and commode to inward positions. For further particulars the circuit of FIG. 8 can be readily traced. "NC" refers to normally closed; "NO" refers to normally opened; "MOM" refers to momentary; lamps are employed to limit transients but are not necessary.

With reference to FIG. 4 and 8, the following operation results; on pressing switch 309 seat insert 70 and commode 106 simultaneously respectively move down from positions "A" and "E" until limit switches 10F and 10H respectively sense when commode 106 and seat insert 70 have reached their downward/outermost limits. Then assuming switch 367S has not been activated to cause the cycle to pause, commode 106 returns from position "F" to position "E" beneath the opening for use. Subsequent to use, the occupant again presses the same switch 309 whereupon commode 106 moves outward from position "E" to position "F". When the commode reaches outward position "F", seat insert moves from lower position "D" to originating position "A". Commode 106 then moves from outward position "F" to reside underneath insert 70 so that lid 90 is fitted on top of the commode at position "E". This is the customary sequence for use resulting from pressing switch 309 twice. If it is desired to interrupt the cycle activating switch 367S will cause the commode to stop the next time it reaches position "F" where it can be removed or repositioned on holders 54, 54B.

The circuit has the advantage that it is activated by a single switch 309 by the operator thus the element of confusion is reduced with inexperienced users or users with limited cognitive abilities. A care taker would also use switch 367S to empty and replace commode 106. The circuit is electrically inactive except when components are in motion thus the circuit consumes very little power for control functions.

FIG. 8 represents the desired embodiment for controls when it is necessary to store the commode under the seat because of space constraints, for example a rocking mechanism under the seat which in a practical embodiment of the Home Chair employed a large battery to shift weight causing the chair to rock when in its rocking configuration.

Commode assembly 67 may use either position "E" or position "F" as its originating position. The originating position of commode 106 being the position of commode 106 when it is not in use.

When sufficient space is available it would generally be preferable to suspend lid 90 over commode 106 at position "F" and thus use position "F" for storage. The control circuit of FIG. 8*a* represents a simplification of FIG. 8. Using the same numbering scheme and part types as in FIG. 8 except employing 400 series numerals instead of 300 series, FIG. 8*a* represents what is believed to be the preferred control method when more space for the commode and seat insert assembly is provided.

In such a configuration the normal mode of operation would consist of pressing a switch such as 409 whereupon seat insert 70 moves from position "A" to "D", then commode 106 moves from position "F" to "E" where it stops for use. After use the operator presses the same switch again and commode 106 moves from position "E" to "F" to fit under lid 90 suspended above position "F". No pause switch 367S or the equivalent would be required since in position "F" the commode is available for emptying. In either type of control system, FIG. 8 or 8*a*, the structure of the seat insert and commode assemblies remains the same, with the exception that commode lid may be suspended by a hook or other common and known means in position "F" rather than position "E". Lid 90 by such means of suspension would cover commode 106 and could be removed with the commode 106 when emptying.

SUMMARY, RAMIFICATIONS, AND SCOPE

While preceding descriptions contain many specificities, these should not be construed as limitations on the scope of the invention, but rather as an exemplification of one preferred embodiment thereof. Many other variations are possible which are within the spirit of the invention and the scope of the claims. For example, the advantages of the angular positioning of the seat insert during movement has been taught in this disclosure. A variety of means can be employed to achieve this effect by using other linkages (for example levers and connecting arms rather than roller chain and sprockets) or separate driving means that depart from the exemplification of the embodiment disclosed herein.

Thus the scope of the invention should be determined by the appended claims and their legal equivalents, rather than by the examples given.

I claim:

1. A seat insert assembly, suitable for use in an article of furniture, comprising:

a seat insert;

a supporting means for said seat insert rotatably connected at a first point of rotation to supporting structure within said article of furniture, said supporting means adapted to move said seat insert upwardly into an opening in a seat of said article of furniture and to move said seat insert downwardly to expose said opening in said seat, whereby said seat insert provides occupant support when in a first position, and provides an opening within said seat of said article of furniture when in a second position remote from said first position, said supporting means providing the sole support of said seat insert during rotation; and a means for angularly positioning said seat insert about said supporting means wherein said seat insert is rotatably connected at a second point of rotation to said supporting means such that upon rotation of said supporting means said means for angularly positioning said seat insert separately rotates said seat insert about said supporting means such that the direction of rotation of said seat insert about said supporting means as said seat insert approaches said first position is opposite the direction of rotation of said seat insert about said supporting means as said seat insert approaches said second position and the rotation of said seat insert with respect to the horizontal is less than 360 degrees.

2. A seat insert assembly of claim 1 wherein said means for angularly positioning of said seat insert about said supporting means is adapted to rotate said seat insert about said supporting means and is not directly linkably connected to a rotating driving means, such as a motor.

3. A seat insert assembly of claim 1 wherein a second rotating means for said seat insert is linkably connected to a substantially stationary means.

4. A seat insert assembly of claim 1 wherein an occupant supporting component of said seat insert is springably supported within said seat insert.

5. A seat insert assembly of claim 1 wherein said supporting means for said seat insert is rotatable about an axis, said axis being rotatably connected at said first point of rotation to said article of furniture.

6. A seat insert assembly of claim 1 wherein the rotation of said supporting means is in an opposite direction from the rotation of a second rotating means for said seat insert such that counterclockwise rotation of said supporting means with respect to the article of furniture is accompanied by clockwise rotation of said second rotating means for said seat insert with respect to said supporting means.

7. A seat insert assembly of claim 1 wherein said supporting means and said angularly positioning means are adapted, and define a path of movement of said seat insert also adapted to cooperate with a commode assembly to provide access via said opening to a commode receptacle for use by an occupant.

8. A seat insert assembly of claim 1 further comprising a rotating driving means connected and adapted to move said seat insert from said first position at said opening to a second position remote from said opening, wherein rotation of seat insert is produced by continuous engagement, as opposed to intermittent engagement, between said seat insert and a said rotating driving means, such as a motor.

9. A seat insert assembly of claim 1 wherein said supporting means fully supports said seat insert and is rotatably supported and connected to the article of furniture at a single axis.

10. A seat insert assembly of claim 1 further comprising a rotating driving means connected and adapted to move said seat insert from said first position at said opening to a second position remote from said opening, wherein said rotating driving means rotates in one direction as the seat insert approaches said first position and rotates in the opposite direction as the seat insert approaches said second position.

11. A seat insert assembly of claim 1 wherein said means for angularly positioning seat insert is responsive to rotation of said supporting means.

12. A seat insert assembly, suitable for use in an article of furniture, comprising:

a seat insert;

a supporting means for said seat insert connected to supporting structure within said article of furniture, said supporting means adapted to move said seat insert upwardly into an opening in a seat of said article of furniture and to move said seat insert downwardly to expose said opening in said seat, whereby said seat insert provides occupant support when in a first position, and provides an opening within said seat of said article of furniture when in a second position remote from said first position; and a means for angularly positioning said seat insert about said supporting means; wherein in said seat insert assembly a first sprocket A is connected to said article of furniture and a second sprocket B is attached to said seat insert, and wherein said first sprocket A and said second sprocket B are linkably connected, said first sprocket A being approximately stationary with respect to supporting means for said seat insert, and said second sprocket B being rotatably connected to said supporting means, said interconnections of said first sprocket A, said second sprocket B, said seat insert, and said supporting means thereby defining rotation of said seat insert with respect to an originating position of said seat insert.

13. A seat insert assembly of claim 12 wherein the rotation of said seat insert is approximately defined by the formula $RT=R\times S$ where $R=(A-B)/B$, where S equals the degree of rotation of said supporting means, where A equals the number of teeth in said first sprocket A, where B equals the number of teeth in said second sprocket B, and where RT approximates the degree of rotation of said seat insert with respect to said originating position.

14. A seat insert assembly, suitable for use in an article of furniture, comprising:

a seat insert;

a supporting means having a first point of rotation and a second point of rotation, wherein at said first point of rotation said supporting means is rotatably connected to a supporting structure within said article of furniture and wherein at said second point of rotation said supporting means is rotatably connected to said seat insert, said supporting means providing the sole support of said seat insert during rotation;

a linkage between said first point of rotation and said second point of rotation, said linkage being connected to a means substantially stationary proximate to said first point of rotation and connected to said seat insert proximate to said second point of rotation, said linkage to said substantially stationary means serving to define the rotational position of said seat insert when said supporting means rotates about said first point of rotation; and a means for applying power to rotate said support means whereby when rotational power is applied to said supporting means said seat insert is positionable into engaged and disengaged positions, said seat insert being made to rotate about said supporting means in response to its linkage to said substantially stationary means, whereby said seat insert provides occupant support when engaged in a first position, and provides an opening within said seat of said article of furniture when disengaged in a second position remote from said first position.

* * * * *